US010857695B2

(12) United States Patent
Mase et al.

(10) Patent No.: US 10,857,695 B2
(45) Date of Patent: Dec. 8, 2020

(54) METHOD OF SURFACE TREATMENT FOR CERAMIC AND CERAMIC ARTICLE

(71) Applicant: FUJI MANUFACTURING CO., LTD, Tokyo (JP)

(72) Inventors: Keiji Mase, Tokyo (JP); Shozo Ishibashi, Tokyo (JP); Yusuke Kondo, Tokyo (JP)

(73) Assignee: FUJI MANUFACTURING CO., LTD., Tokyo (JP)

( * ) Notice: Subject to any disclaimer, the term of this patent is extended or adjusted under 35 U.S.C. 154(b) by 413 days.

(21) Appl. No.: 16/021,771

(22) Filed: Jun. 28, 2018

(65) Prior Publication Data

US 2019/0016013 A1 Jan. 17, 2019

(30) Foreign Application Priority Data

Jul. 13, 2017 (JP) ..... 2017-137019

(51) Int. Cl.
*B28B 11/08* (2006.01)
*B24C 1/04* (2006.01)
(Continued)

(52) U.S. Cl.
CPC ..... *B28B 11/0818* (2013.01); *B24C 1/04* (2013.01); *B24C 7/0061* (2013.01); *B24C 11/00* (2013.01)

(58) Field of Classification Search
CPC ..... B28B 11/0818; B24C 1/04; B24C 7/061; B24C 11/00
See application file for complete search history.

(56) References Cited

U.S. PATENT DOCUMENTS

2002/0077042 A1 6/2002 Izawa et al.
2012/0043044 A1* 2/2012 Mase ..... B29C 45/263 164/6
(Continued)

FOREIGN PATENT DOCUMENTS

EP 0694362 A1 1/1996
JP 06-297254 10/1994
(Continued)

OTHER PUBLICATIONS

Corresponding Japanese Appl., Japanese Office action, Appl. No. 2017-137019, dated Dec. 10, 2018.

*Primary Examiner* — Dung Van Nguyen
(74) *Attorney, Agent, or Firm* — Cooper Legal Group, LLC; Ronald M. Kachmarik

(57) ABSTRACT

A surface treatment method is provided that is capable of raising the slidability of a ceramic surface at low cost using a comparatively simple method. Dimples are formed on a surface of a treatment region, this being a portion of a ceramic surface where surface treatment is to be performed, by ejecting substantially spherical ejection particles having a median diameter of from 1 μm to 20 μm, together with compressed gas at an ejection pressure of from 0.01 MPa to 0.7 MPa, so as to achieve a value of a fastest decay autocorrelation length of not less than 10. The dimples are formed so as to have a plan view profile with a ratio between a horizontal Feret diameter and a vertical Feret diameter of from 0.7 to 1.43. Thereby a ceramic surface with improved slidability can be obtained regardless of use or non-use of a lubricant.

12 Claims, 2 Drawing Sheets

(51) Int. Cl.
*B24C 7/00* (2006.01)
*B24C 11/00* (2006.01)

(56) References Cited

U.S. PATENT DOCUMENTS

2014/0360569 A1* 12/2014 Mase ..... H01L 31/048
136/256
2018/0222089 A1* 8/2018 Mase ..... B22C 9/18
2018/0239066 A1 8/2018 Tachibana et al.

FOREIGN PATENT DOCUMENTS

| | | |
|---|---|---|
| JP | 08-128448 | 5/1996 |
| JP | 2002-137167 | 5/2002 |
| JP | 2002-193693 | 7/2002 |
| JP | 2004-278557 | 10/2004 |
| JP | 2007-112712 | 5/2007 |
| JP | 2008-105091 | 5/2008 |
| JP | 2010-030016 | 2/2010 |
| JP | 2012-033565 | 2/2012 |
| JP | 2016-156428 | 9/2016 |
| WO | 2017057564 A1 | 4/2017 |

* cited by examiner

METHOD OF SURFACE TREATMENT FOR CERAMIC AND CERAMIC ARTICLE

BACKGROUND OF THE INVENTION

1. Field of the Invention

The present invention relates to a method of surface treatment for ceramic and to a ceramic article subjected to the surface treatment. More specifically, the present invention relates to a surface treatment method capable of achieving improved slidability and preventing wear and adhesion to a ceramic surface, improving demoldability, and the like, and to a ceramic article subjected to the surface treatment method.

Note that the ceramic surface of the present invention includes surfaces made from ceramic in general, including surfaces of ceramic articles having a ceramic base material, and also surfaces of ceramic liners adhered to a surface of an article made from a material other than ceramic, or to a surface of a ceramic coating thereon etc. Ceramic articles are articles in general that have at least a portion of surface made from ceramic, and includes articles entirely made from ceramic down to the base material thereof, and also articles that are articles made from a base material other than ceramic that have a surface to which a ceramic liner has been adhered to or that has been ceramic coated.

2. Description of the Related Art

Ceramics have high hardness, and also excellent heat resistance, wear resistance, etc. This means that ceramics are employed as a material for various articles, and are also employed as liner materials, coating materials, and the like for articles that make contact with other members, such as sliding components.

However, even though ceramics have high hardness and excellent heat resistance and wear resistance, when they are caused to make sliding contact with other members in a low slidability state with no lubricant or the like present, durability deteriorates due to friction induced wear, and adhesive wear and the like due to adherence of the counterparty member. Moreover, good demoldability is demanded from ceramic molds and the like in order to raise productivity. Various methods have accordingly been proposed to improve the slidability and demoldability of ceramic surfaces.

A method has been proposed to prevent adhesive wear and to improve the wear resistance of ceramic articles by innovation in the composition itself of ceramic materials. An example thereof is a proposal in Patent Document 1, listed below. In this proposal, a drawing die is configured from a ceramic with a composition of alumina ($Al_2O_3$) at from 3.0 to 25.0 wt %, at least one of dysprosium oxide ($Dy_2O_3$) or ceria ($CeO_2$) at from 8.0 to 13.0 wt %, carbon at from 0.8 to 4.0 wt %, and zirconia ($ZrO_2$) for the remainder. This enables the provision of a drawing die having excellent adhesive wear resistance to stainless steel.

Moreover, Patent Document 2 listed below, describes dies made from a ceramic with a main component of titanium nitride that also contains zirconia and nickel. The ceramic has a structure including a hard phase in which some of the zirconia crystals are dispersed among the titanium nitride crystals, and including a binder phase having a main component of nickel to bind the hard phase. This enables a smaller sliding resistance to extruded material, such as aluminum, to be achieved and prevents adhesion from occurring.

There is also a method proposed to improve the slidability of a ceramic surface by a method in which dimples (depressions) are formed on a sliding surface or the like in order to retain a lubricant such as oil, grease, or the like.

Examples of methods for forming such dimples include methods to form dimples by preparation prior to sintering a ceramic, and methods to form dimples subsequently in the ceramic surface after sintering.

Examples of methods to form dimples by preparation prior to sintering are described in Patent Document 3, listed below. In one method, a resin and a foaming agent, whiskers or the like are added, and blended into, a ceramic raw material serving as a material for molding a sliding member. Then, by sintering after molding, dimples are formed where the added resin and foaming agent were combusted during sintering (Paragraph [0030] in Patent Document 3). In another method described, pre-sintering ceramic raw material is molded using a mold provided with protrusion profiles corresponding to dimples, and then sintering is performed (Paragraph [0031] in Patent Document 3).

An example of a method for subsequently forming dimples in a ceramic after sintering is given in Patent Document 4. In this proposal fine dimples are formed by irradiating a single pulse laser having a short pulse width of a picosecond laser or shorter onto a surface of a ceramic rolling body of a bearing or a constant-velocity joint (Patent Document 4).

RELATED ARTS

Patent Documents

Patent Document 1: JP2007-112712A
Patent Document 2: JP2008-105091A
Patent Document 3: JP H08-128448A
Patent Document 4: JP2016-156428A

Problem to be Solved by the Invention

From among the configurations described above, in methods to improve the slidability of a ceramic article surface by changing the composition of the ceramic material as described in Patent Document 1 and Patent Document 2, a change needs to be made to the material of the ceramic article, such as a drawing die, dies, or the like.

This means that it is not possible to subsequently improve the slidability of ceramic articles that have been manufactured already and are already in use. To obtain improved slidability etc. a new ceramic article needs to be made with one of the ceramic materials described in Patent Document 1 or Patent Document 2. This results in a lot of effort, time, and expense for purchasing materials, prototyping, manufacturing, and the like.

Even when slidability is improved by forming dimples, methods for forming dimples by processing prior to sintering, as is suggested by Patent Document 3, are also not subsequently applicable to ceramic articles that already exist, and these methods require new ceramic articles to be made, similarly to the methods of Patent Document 1.

However, in methods in which dimples are formed by adding and blending a resin and a foaming agent, whiskers or the like into a ceramic raw material and then sintering after molding to form dimples where the added resin, foaming agent, etc. were combusted, a product is obtained in which the profile type, positions and spacings of the obtained dimples are left to chance. Process control to form uniform independent dimples that are not connected to each other is difficult, and this makes the stable manufacture of articles of consistent quality difficult.

Moreover, manufacturing control is also complicated in such a method from the perspective that the type and quantity etc. of added resins, foaming agents, etc. needs to be adjusted for each type of ceramic material for article manufacture, and for each type of article to be manufactured.

In contrast thereto, in methods in which a pre-sintering ceramic raw material is molded using a mold including protrusions with profiles corresponding to dimples and then sintered, the articles molded using these molds are all formed with dimples at the same position and having the same profile. From this perspective, variation in quality between articles can be eliminated. However, in order to improve the slidability of ceramic articles when forming dimples by such methods, obviously a new ceramic article itself needs to be made in order to improve slidability. New molds for molding to manufacture such ceramic articles also need to be made, further raising manufacturing costs.

In contrast thereto, in the method for forming fine dimples by emitting a single pulse laser onto a surface of a ceramic article as described in Patent Document 4, the dimples can be formed subsequently on the ceramic articles after sintering. This enables slidability and the like to be improved when dimples are formed on newly manufactured ceramic articles, obviously, but also when dimples are formed subsequently on ceramic articles that have been manufactured and are already in use.

Moreover, such a method enables ceramic articles to be manufactured with consistent quality by forming dimples of constant size and depth, and by forming patterns with uniform spacings by emitting the single pulse laser.

However, in order to form patterns of dimples using the method described in Patent Document 4, a complicated operation is required to form dimples one-by-one by emitting the single pulse laser accurately at a predetermined intensity, for a predetermined time, and at predetermined time interval, while also rotating the ceramic articles, such as rolling bodies of bearings or the like, one-by-one in a predetermined direction. It accordingly takes a long time to form the dimples on a single ceramic article, thus the manufacturing cost of ceramic articles is greatly increased when dimples are formed by such a method.

Note that although conventional methods to improve the slidability of ceramic articles by forming dimples have been obtained improved slidability by retaining lubricants such as oil, grease, etc. inside the dimples formed in this way, they have not been able to obtain improved slidability in a state in which there is no lubricant retained therein.

However, depending on the application of the ceramic article, lubricants such as oil, grease, etc. cannot be used in some cases. There are also demands to not use lubricants such as oil, grease, etc., or to reduce the quantity used thereof, due to the recent growing awareness of the need to protect the environment. This means that there is a desire for a proposal for a method capable of contributing to the slidability of a ceramic surface even when lubricant or the like is not employed.

The present invention is made to address such demands, and an object thereof is to provide a surface treatment method that can be performed to raise slidability by subsequently treating post-sinter ceramic surfaces at low cost using a comparatively simple method, and that can contribute to high slidability when there is no lubricant present between contact surfaces, as well as obviously when a lubricant such as oil, grease, etc. is present. An object is also to provide a ceramic article having excellent wear resistance and adhesion resistance, demoldability, and durability by provision of this surface treatment method.

SUMMARY OF THE INVENTION

In order to achieve the above object, a method of surface treatment for a ceramic surface according to the present invention comprises the step of:

ejecting substantially spherical ejection particles having a median diameter d50 of from 1 μm to 20 μm, together with compressed gas at an ejection pressure of from 0.01 MPa to 0.7 MPa, onto a surface of a treatment region, this being a portion of a ceramic surface where surface treatment is to be performed, so as to form dimples on the surface of the treatment region and achieve a value of a fastest decay autocorrelation length (Sal) of the treatment region of not less than 10.

"Median diameter d50" refers to the diameter at a cumulative mass 50 percentile, namely, to a diameter that when employed as a particle diameter to divide a group of particles into two, results in the total mass of particles in the group of particles of larger diameter being the same as the total mass of particles in the group of particles of smaller diameter. This is the same definition as "particle diameter at a cumulative height 50% point" in JIS R 6001 (1987).

Moreover, fastest decay autocorrelation length (Sal) is one surface profile parameter in ISO 25178, and is expressed as a horizontal distance in the direction where an autocorrelation function (ACF) decays the fastest to a predetermined value.

Preferably, the dimples are formed so as to have a plan view profile with a Feret diameter ratio of from 0.7 to 1.43.

The Feret diameter ratio therein is a ratio between sides parallel to the X axis and sides parallel to the Y axis that configure a rectangle S circumscribing a plan view profile of an imaged dimple, i.e. a ratio (horizontal Feret diameter 1x/vertical Feret diameter 1y) between a length of the sides parallel to the X axis (horizontal Feret diameter 1x) and a length of the sides parallel to the Y axis (vertical Feret diameter 1y) (see FIG. 1).

Preferably, the dimples have an opening diameter of from 1 μm to 20 μm and a depth of from 0.01 μm to 1 μm.

Moreover, the dimples are preferably formed such that a total surface area of openings of the dimples is not less than 50% of a surface area of the treatment region.

Furthermore, a ceramic article according to the present invention comprises a treatment region that is at least a portion of a surface section made from ceramic, the treatment region including dimples having an opening diameter of from 1 μm to 20 μm and a depth of from 0.01 μm to 1 μm, and a surface of the treatment region having a value of a fastest decay autocorrelation length (Sal) of not less than 10.

Preferably, the dimples have a plan view profile with a Feret diameter ratio of from 0.7 to 1.43.

Moreover, a total surface area of openings of the dimples is preferably 50% or more of a surface area of the treatment region.

According to the configuration of the present invention as described above, the surface treatment method of the present invention is able to form dimples subsequently on a surface of a post-sinter ceramic article at a low cost using a comparatively simple method.

Moreover, by adjusting such that the three-dimensional surface profile after dimple formation has a value of fastest decay autocorrelation length (Sal) not less than 10, the slidability of the ceramic surface is raised, and wear and adhesion are prevented from occurring not only, obviously, when a lubricant such as oil, grease, etc. is supplied and retained in the dimples, but also when no such lubricant is supplied and there is no lubricant retained inside the dimples. This enables the durability of ceramic articles to be improved, and also enables higher productivity to be achieved due to good demoldability when the surface treatment method of the present invention is applied to internal surfaces of cavities in a ceramic mold.

BRIEF DESCRIPTION OF THE DRAWINGS

The objects and advantages of the invention will become understood from the following detailed description of preferred embodiments thereof in connection with the accompanying drawings in which like numerals designate like elements, and in which.

DETAILED DESCRIPTION OF THE PREFERRED EMBODIMENTS

Figure 1:
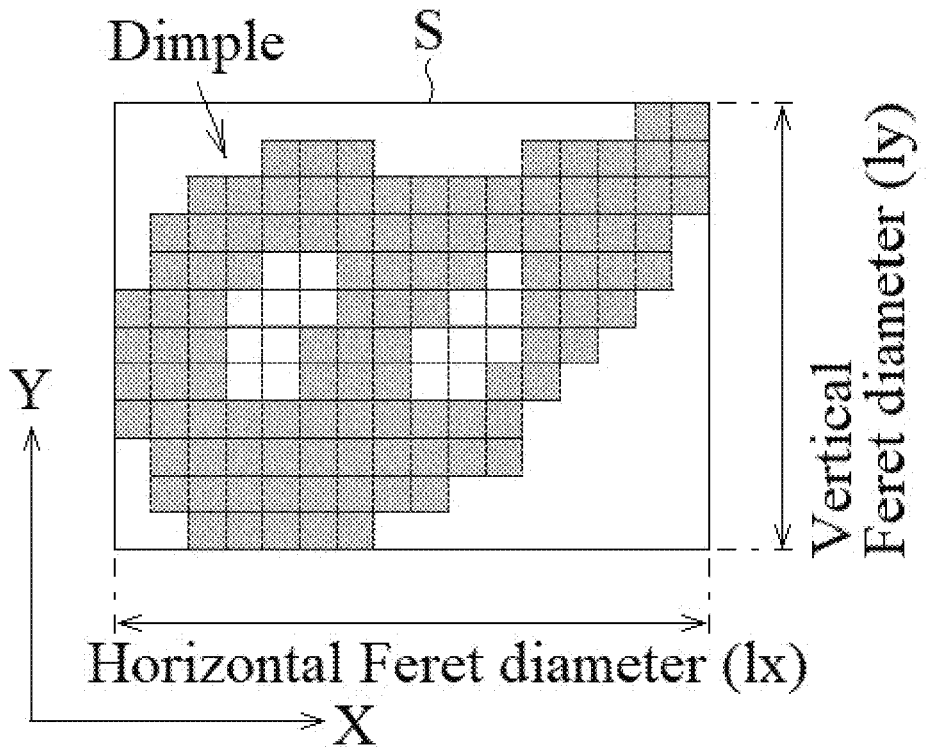
FIG. 1 is a diagram to explain a Feret diameter ratio.

Explanation follows regarding embodiments of the present invention, with reference to the appended drawings.

(Object to be Treated)

The object to be treated of the present invention includes various articles having at least a portion of the surface thereof configured from ceramic, such as ceramic articles formed from ceramic down to the base material thereof, and also articles having a ceramic liner adhered to the surface of a base material made from metal or having a ceramic coating on the surface thereof. These are all included as ceramic articles of the present invention.

Such ceramics include inorganic solid materials in general mainly made from non-metals, such as oxides, carbides, nitrides, borides, silicides, fluorides, sulfides, carbon, etc. Examples of ceramics of the present invention include alumina ($Al_2O_3$), zirconia ($ZrO_2$), silicon dioxide ($SiO_2$), barium titanate ($BaO_3Ti$), yttrium oxide ($Y_2O_3$), silicon carbide (SiC), tungsten carbide (WC), titanium carbide (TiC), silicon nitride ($Si_3N_4$), titanium nitride (TiN), titanium aluminum nitride (TiAlN), titanium boride ($TiB_2$), zirconium boride ($ZrB_2$), molybdenum silicide ($MoSi_2$), tungsten silicide ($WSi_2$), calcium fluoride ($CaF_2$), diamond-like carbon (DLC), and glass (such as soda glass, lead glass, borosilicate glass) whose main component is the above listed silicon dioxide ($SiO_2$).

Moreover, the method of the present invention is applicable to various articles, irrespective of what the article is used for, as long as the article is formed with ceramic, as described above. The treatment of the present invention may also be performed on a portion of the surface of an article. When applied to a sliding member employed to contact another member, such as a bearing, shaft, gear wheel, or the like, then the treatment may be applied just to parts of the sliding member that slide against the other member.

(Treatment Method)

The surface treatment method of the present invention is performed on a treatment region, this being a portion where the surface treatment method of the present invention is to be performed on the surface of the article to be treated, by ejecting substantially spherical ejection particles together with compressed gas so as to bombard the treatment region.

Examples of ejection particles, ejection apparatus, and ejection conditions employed when performing the above treatment are given below.

(1) Ejection Particles

For the substantially spherical ejection particles employed in the surface treatment method of the present invention, "substantially spherical" means that they do not need to be strictly "spherical", and ordinary "shot" may be employed therefor. Particles of any non-angular shape, such as an elliptical shape and a barrel shape for example, are included in the "substantially spherical ejection particles" employed in the present invention.

Materials that may be employed for the ejection particles include both metal-based and ceramic-based materials. Examples of materials for metal-based ejection particles include steel, high-speed tool steels (HSS), stainless steels, chromium boron steels (FeCrB), and the like. Examples of materials for ceramic-based ejection particles include alumina ($Al_2O_3$), zirconia ($ZrO_2$), zircon ($ZrSiO_4$), silicon carbide (SiC), hard glass, and the like.

Regarding the particle diameter of the ejection particles employed, particles having a median diameter (d50) in a range of from 1 μm to 20 μm may be employed.

(2) Ejection Apparatus

A known blasting apparatus for ejecting abrasive together with a compressed gas (air, argon, nitrogen, or the like) may be employed as the ejection apparatus to eject the ejection particles described above against the surface of the article to be treated.

Such blasting apparatuses are commercially available, such as a suction type blasting apparatus that ejects abrasive using a negative pressure generated by ejecting compressed gas, a gravity type blasting apparatus that causes abrasive falling from an abrasive tank to be carried on and ejected by compressed gas, a direct pressure type blasting apparatus in which compressed gas is introduced into a tank filled with abrasive and the abrasive is ejected by merging the abrasive flow from the abrasive tank with a compressed gas flow from a separately provided compressed gas supply source, and a blower type blasting apparatus that carries and ejects the compressed gas flow from a direct pressure type blasting apparatus with a gas flow generated by a blower unit. Any one of the above may be employed to eject the ejection particles described above.

(3) Treatment Conditions

Substantially spherical ejection particles formed with a median diameter d50 of from 1 μm to 20 μm using one of the materials described above or the like are ejected, together with compressed gas at an ejection pressure of from 0.01 MPa to 0.7 MPa, against the ceramic article to be treated described above.

This thereby enables dimples having an opening diameter of from 1 μm to 20 μm, and a depth of from 0.01 μm to 1 μm, to be formed on the surface of the ceramic.

The ejection of the ejection particles is performed such that the total surface area of openings of the dimples formed is not less than 50% of the surface area of the treatment region.

(4) Fastest Decay Autocorrelation Length (Sal)

Dimple formation is performed such that the surface of the treatment region after dimple formation has a value of fastest decay autocorrelation length (Sal) as defined by ISO 25178 of not less than 10, and is preferably performed such that, in addition thereto, a Feret diameter ratio of the dimples formed is from 0.7 to 1.43.

The fastest decay autocorrelation length (Sal) is expressed as a horizontal distance in a direction in which an autocorrelation function (ACF) represented by Equation (1) decays the fastest to a specific value, and is expressed by the following Equation (2).

$$f_{ACF}(t_x, t_y) = \frac{\iint_A z(x, y)z(x - t_x, y - t_y)dxdy}{\iint_A z(x, y)z(x, y)dxdy} \quad \text{Equation (1)}$$

$$S_{al} = \min_{t_x, t_y \in R} \sqrt{t_x^2 + t_y^2} \quad \text{Equation (2)}$$

$$\text{where, } R = \{(t_x, t_y): f_{ACF}(t_x, t_y) \leqq s\}$$

The above autocorrelation function (ACF) takes a surface ($Z(x-t_x, y-t_y)$ superimposed on a measured surface ($Z(x, y)$), and computes a multiplication product calculated for two surfaces placed together at a relative displacement ($t_x$, $t_y$) in the horizontal direction. A function of the multiplication product result is integrated and normalized, to obtain a measure of the overlap between the two functions.

Suppose that the displaced surface is the same as the original surface, then the autocorrelation function (ACF) would be 1.00. Alternatively, suppose that the displaced surface is one in which valleys are arrayed so as to correspond to all of the peaks, then the autocorrelation function (ACF) would be −1.00.

Thus the autocorrelation function (ACF) is a measure indicating the degree of likeness in surface texture of the object to be measured at a predetermined distance from the original position.

When the autocorrelation function (ACF) approaches 1.00 for a predetermined displacement amount, this indicates a good likeness for surface texture along this direction and autocorrelation. When the autocorrelation function rapidly approaches zero along a predetermined direction, then this indicates the state of the surface is different and there is no autocorrelation.

As represented by Equation (2), the fastest decay autocorrelation length (Sal) is a distance found when the autocorrelation function (ACF) decays the fastest to a predetermined value, wherein s in the Equation is the correlation value ($0 \leq s < 1$), and is normally 0.2.

In this manner, the fastest decay autocorrelation length (Sal) finds a distance where the autocorrelation function (ACF) decays the fastest to a predetermined value, enabling quantification of the severity of change in height of a surface, this being a property that is not represented by the arithmetic mean height Sa (the mean of absolute values of height difference at each point from an average plane of a surface: ISO 25178).

In these results, when, for example, irregularities formed on a surface are predominantly short wavelength components (steep height changes), then the autocorrelation function (ACF) decays rapidly and so the value of the fastest decay autocorrelation length (Sal) is small. However, when long wavelength components predominate (gentle height changes), the autocorrelation function (ACF) decays slowly, and so the value of the fastest decay autocorrelation length (Sal) is large.

In the present invention, dimple formation is performed such that the fastest decay autocorrelation length (Sal) is not less than 10. This means that the profile obtained does not have steep changes in height, and so comparatively shallow dimples are formed thereby.

(5) Feret Diameter

In the present invention, as well as forming comparatively shallow dimples due to the fastest decay autocorrelation length (Sal) being not less than a predetermined value, preferably the dimples are also adjusted such that the Feret diameter ratio thereof is in a range of from 0.7 to 1.43 so that the dimples exhibit functionality to trap oil and air.

The Feret diameter ratio is a ratio between sides parallel to the X axis and sides parallel to the Y axis that configure a rectangle S circumscribing a plan view profile of a dimple imaged with a laser microscope or the like as illustrated in FIG. 1. The Feret diameter ratio is expressed as a ratio (horizontal Feret diameter 1x/vertical Feret diameter 1y) between a length of the sides parallel to the X axis (horizontal Feret diameter 1x) and a length of the sides parallel to the Y axis (vertical Feret diameter 1y).

In the plan view profile of dimples formed by bombarding with substantially spherical shot, the dimples are substantially circular, and the dimples each have a profile approaching a circular shape when the lengths of the horizontal Feret diameter 1x and the vertical Feret diameter 1y are the same as each other, and thus the Feret diameter ratio approaches 1.0.

Thus by forming dimples with a Feret diameter ratio lying within the above numerical range, dimples with a profile having a large difference between the horizontal Feret diameter (1x) and the vertical Feret diameter (1y) are not formed. This enables the dimples formed to be those with profiles comparatively close to a circular shape, and enables dimples with groove shapes due to plural dimples merging to be prevented from being formed, and enables indentations with profiles that do not readily retain lubricant or gas, such as the depressions of residual tool marks (cutting marks) to be prevented from being formed.

The Feret diameter ratio can be acquired by using a laser microscope equipped with a profile analysis function to image a post-treatment ceramic surface. In the present embodiment, a profile analyzing laser microscope ("VK-X250") manufactured by Keyence Corporation was employed for measuring at an measurement amplification of 1000×. Analysis software for this laser microscope "Multi-File Analysis Application VK-HIMX" was employed on the measurement data to find the Feret diameter ratio.

(Operation Etc.)

As described above, height changes on the surface of the treatment region are comparatively gentle due to the value of the fastest decay autocorrelation length (Sal) being not less than 10 in the present invention.

Figure 2:
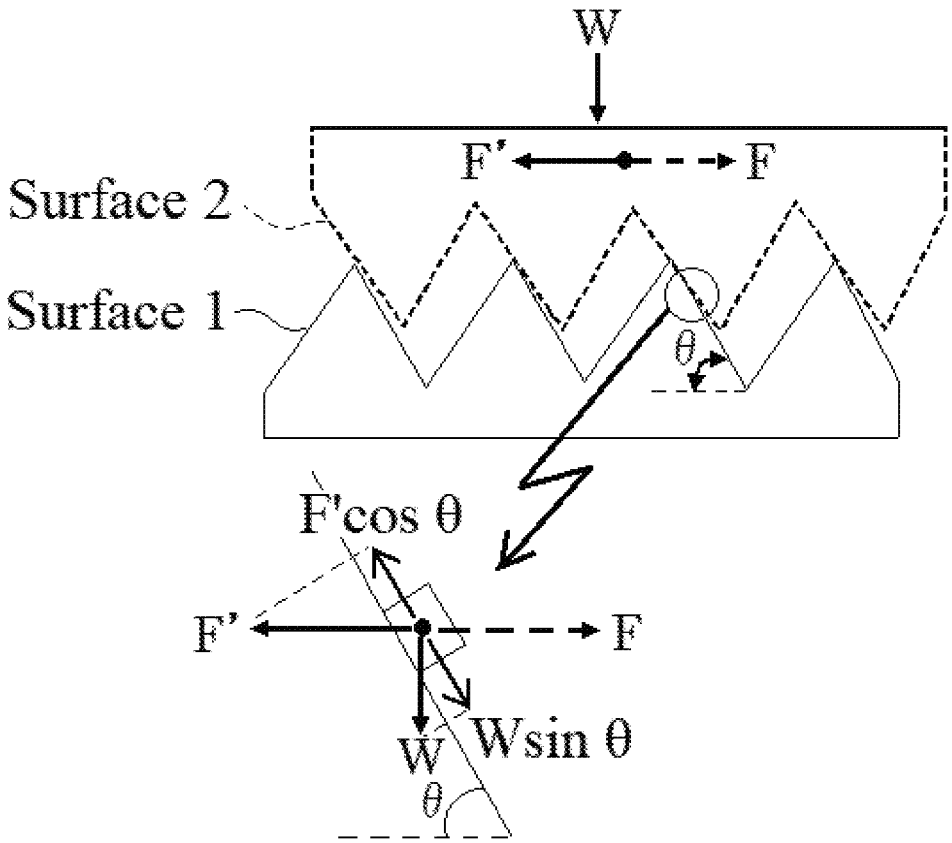
FIG. 2 is a diagram to explain sliding resistance between rough surfaces.

Consider how the sliding resistance occurring by mating indentations and protrusions formed on two sliding surfaces (surface 1, surface 2) causes an increase in frictional force when two surfaces are in sliding contact, as illustrated in FIG. 2. The protrusions on surface 2 need to overcome a load W to pass over the protrusions on surface 1, and it is the energy loss incurred to pass over that increases the frictional force exhibited as sliding resistance F.

When an external force F' equal to sliding resistance F is applied, then a force (F' cos θ) acting to move up sloping faces of protrusions having a slope angle θ balances a force (W sin θ) from the load acting to move down the sloping faces. Thus:

$$F' \cos\theta = W \sin\theta$$

The sliding resistance F is equal to the external force F as stated above, and so:

$$F=F'=W \sin \theta/\cos \theta=W \tan \theta$$

Thus assuming that load W is constant, then the sliding resistance F changes in proportion to "tan θ", namely, slope angle θ, accordingly, there also being a corresponding change in frictional force.

When the numerical value of the fastest decay autocorrelation length (Sal) is small this indicates that there are steep changes in the height of the post-treatment surface. This means that the surface indentations and protrusions have acute profiles as illustrated in FIG. 2, and so the slope angle θ of the protrusions is large, accordingly, the sliding resistance F is large.

However, a post-treatment surface of the present invention has a fastest decay autocorrelation length (Sal) of not less than 10. This means that a surface state without steep changes in height is obtained, and a profile with comparatively gentle height changes is obtained instead. Long wavelength components predominate in the surface indentations and protrusions, the indentations and protrusions have gentle profiles with small slope angle θ. As a result the sliding resistance F is small.

Thus by forming the dimples in the present invention while controlling the fastest decay autocorrelation length (Sal), a surface profile can be obtained that is capable of reducing the sliding resistance F even while forming indentations and protrusions on the surface by forming dimples. Improving the slidability of the ceramic surface thereby improves the wear resistance and makes adhesion not liable to occur.

Moreover, when such a surface is formed on a surface of a ceramic mold, this enables the demoldability of molded articles to be improved, enabling higher productivity to be achieved.

Moreover, the dimples formed by the method of the present invention are formed so that the above Feret diameter ratio (1x:1y) lies in the range of from 0.7 to 1.43. This enables dimples to be formed having a profile that is comparatively close to a circular shape and readily retains gas and lubricant. A ceramic surface can accordingly be obtained that has higher slidability, excellent wear resistance and adhesion resistance, and has excellent demoldability etc. due to retaining gas and lubricant in the dimples.

(Adhesion Test 1)

(1) Test Objective

To confirm that performing surface treatment according to the method of the present invention makes adhesion to a ceramic surface not liable to occur.

(2) Test Method

Surface treatment using the method of the present invention was performed on the surface of zirconia ($ZrO_2$) test pieces (40 mm×40 mm×2 mm) (Example 1, Example 2). A ball-on-disk friction-wear tester was employed with SUS304 balls and A1050 balls (both of 3/16 inch diameter) to perform friction-wear tests without lubricant on these samples and on a polished product that had been polished to an arithmetic mean roughness Ra (JIS B0601 1994) of 0.1 μm (Comparative Example 1). The adherence state of ball material to the surface of rubbed portions was confirmed.

Note that the reason SUS304 was selected as the material of the balls is that SUS304 has an extremely low thermal transmittance, i.e. ¼ that of ordinary steel materials. This means that heat generated by friction does not readily dissipate, leading to localized high temperatures readily arising and adhesion readily occurring. It can accordingly be predicted that if adhesion of SUS304 could be prevented then this would mean that adhesion with other steel materials could also be prevented.

The reason A1050 was selected is that aluminum is a material with a low melting point that readily adheres when localized high temperature occurs with friction. In particular, A1050 has an aluminum content of 99.5% or greater and is what is referred to as "pure aluminum". A1050 accordingly has the lowest strength of aluminum alloys and readily adheres. It can accordingly be predicted that if adhesion of A1050 could be prevented from occurring then this would mean that adhesion of other non-ferrous metals could also be prevented.

(3) Test Conditions (3-1) Surface Treatment Conditions

The surface treatment conditions for each of the test pieces are given in Table 1 below.

TABLE 1

Surface Treatment Conditions

| | Example 1 | Example 2 | Comparative Example 1 |
|---|---|---|---|
| Ejection Apparatus | SFK-2: manufactured by Fuji Manufacturing Co., Ltd. | FDQ-3: manufactured by Fuji Manufacturing Co., Ltd. | Product polished to an Ra of 0.1 μm |
| Ejection Type | Suction type | Direct pressure type | |
| Ejection particle (d50 diameter) | Alumina (8 μm) | Zirconia (15 μm) | |
| Ejection pressure (MPa) | 0.5 | 0.3 | |
| Nozzle internal diameter (mm) | 7 | 5 | |
| Ejection duration (sec) | 120 | 60 | |
| Fastest decay autocorrelation length (Sal) | 16.76 | 13.39 | 6.64 |
| Feret diameter ratio | 0.91 | 1.14 | 0.57 |

(3-2) Ball-on-Disc Treatment Conditions

The conditions for the ball-on-disc friction-wear tests on the test pieces for Examples 1 and 2 and the Comparative Example 1 are given in Table 2 below.

TABLE 2

Ball-on-disc friction-wear test conditions

| Probe | SUS304 ball (φ 3/16 inches) | A1050 ball (φ 3/16 inches) |
|---|---|---|
| Load (gf) | 500 | 100 |
| Sliding width (mm) | 10 | 10 |
| Line speed (mm/sec) | 10 | 10 |
| Test duration (sec) | 900 | 900 |

(3-3) Adherence Quantity Measurement Method

After the ball-on-disc friction-wear tests had been performed under the conditions listed above, energy dispersive X-ray spectrometry (EDX) was then employed on the test pieces (Examples 1, 2 and Comparative Example 1) to confirm adhered elements.

The mass concentration of iron (Fe) components was confirmed for the test pieces after performing the friction-wear test with the SUS304 balls, and the mass concentration of aluminum (Al) components was confirmed for the test pieces after performing the friction-wear test with the A1050 balls.

(4) Test Results

The results of the adherence quantity measurements for SUS304 and A1050 on each of the test pieces are listed in Table 3 below.

TABLE 3

Adherence quantity to each test piece

| | Example 1 | Example 2 | Comparative Example 1 |
|---|---|---|---|
| SUS304 adherence (%) | 8.08 | 10.25 | 13.21 |
| A1050 adherence (%) | 5.68 | 6.11 | 8.63 |

The above results confirmed that, compared to Comparative Example 1 not subjected to the surface treatment according to the method of the present invention, the adherence quantity of both SUS304 and A1050 was reduced with the test pieces of Examples 1 and 2 that had been surface treated with the method of the present invention, even though no lubrication was performed.

In particular, the fastest decay autocorrelation length (Sal) had a larger numerical value, and the Feret diameter ratio was near to 1.00, for Example 1 compared to the test piece for Example 2; however, the adherence quantity of both SUS304 and A1050 was reduced. This confirmed that treating a surface to achieve a large fastest decay autocorrelation length (Sal) and to achieve a surface profile having a Feret diameter ratio close to 1.00, as in the surface treatment method of the present invention, was effective in preventing adherence to ceramic surfaces. This effect was moreover obtained without lubrication.

(Adherence Test 2)

(1) Test Objective

To confirm that adherence does not readily occur to a ceramic surface on which the surface treatment method of the present invention has been performed.

(2) Test Method

Surface treatment using the method of the present invention was performed on the surface of a zirconia ($ZrO_2$) mold, for extrusion molding an aluminum alloy (Example 3, Example 4, Example 5). Aluminum alloy was extrusion molded without lubricant using these samples and a polished product (Comparative Example 2) that had been lap polished to an arithmetic mean roughness Ra (JIS B0601 1994) of 0.1 μm or less. Whether or not aluminum alloy had adhered to portions of the molds in sliding contact with the aluminum alloy was confirmed.

(3) Test Conditions

The surface treatment conditions for each of the molds are given in Table 4 below.

TABLE 4

Surface Treatment Conditions

| | Example 3 | Example 4 | Example 5 | Comparative Example 2 |
|---|---|---|---|---|
| Ejection Apparatus | SFK-2: manufactured by Fuji Manufacturing Co., Ltd. | LDQ-3: manufactured by Fuji Manufacturing Co., Ltd. | FDQ-3: manufactured by Fuji Manufacturing Co., Ltd. | Lap polished to an Ra of 0.1 μm or less |
| Ejection Type | Suction type | Blower type | Direct pressure type | |
| Ejection particle (d50 diameter) | Alumina (16 μm) | Zirconia (10 μm) | Steel alloy (6 μm) | |
| Ejection pressure (MPa) | 0.2 | 0.03 | 0.3 | |
| Nozzle internal diameter (mm) | 7 | 9 | 5 | |
| Ejection duration (sec) | 60 | 120 | 60 | |
| Fastest decay auto-correlation length (Sal) | 15.89 | 11.14 | 13.86 | 4.12 |
| Feret diameter ratio | 0.86 | 0.77 | 1.22 | 1.37 |

(4) Test Results

The results of determinations with the naked eye of the adherence state of aluminum alloy to each of the extrusion molding molds are listed in Table 5 below.

TABLE 5

| Adherence quantity to extrusion molding molds | | | | |
|---|---|---|---|---|
| | Example 3 | Example 4 | Example 5 | Comparative Example 2 |
| Adherence state | Extremely light | Light | Extremely light | Heavy |

It is apparent from the above results that the adherence of aluminum alloy was reduced for all the extrusion molding molds of Examples 3 to 5 that had been subjected to the surface treatment method of the present invention, compared to the extrusion molding mold of the Comparative Example 2 that had been lap polished.

In particular, it was confirmed that Example 3 and Example 5, having a larger fastest decay autocorrelation lengths (Sal) than Example 4 and a Feret diameter ratio close to 1.0, were less susceptible to adherence that Example 4. This confirmed that processing a surface, as in the surface treatment method of the present invention, to achieve a large fastest decay autocorrelation length (Sal), and a small ratio between the lengths of the horizontal Feret diameter 1x and the vertical Feret diameter 1y is effective for preventing adherence to ceramic surfaces.

(Sliding Test)

(1) Test Objective

To confirm an improvement in slidability of ceramic surfaces by performing the surface treatment method of the present invention.

(2) Test Method

The surface treatment method of the present invention was performed on the surface of a drug injection piston made from zirconia ($ZrO_2$) (Example 6, Example 7). The magnitude of sliding resistance for reciprocating movement was then evaluated for these examples and for a polished product that had been lap polished to an arithmetic mean roughness Ra of 0.2 μm or less (Comparative Example 3) inserted inside respective resin cylinders without lubricant (no oil or water present).

(3) Test Conditions

The surface treatment conditions for each piston are listed in Table 6 below.

TABLE 6

| Surface Treatment Conditions | | | | |
|---|---|---|---|---|
| | Example 6 | Example 7 | Example 8 | Comparative Example 3 |
| Ejection Apparatus | SFK-2: manufactured by Fuji Manufacturing Co., Ltd. | LDQ-3: manufactured by Fuji Manufacturing Co., Ltd. | FDQ-3: manufactured by Fuji Manufacturing Co., Ltd. | Lap polished to Ra 0.2 μm or less |
| Ejection Type | Suction type | Blower type | Direct pressure type | |
| Ejection particle (d50 diameter) | Silicon carbide (8 μm) | Zircon (18 μm) | Alumina (5 μm) | |
| Ejection pressure (MPa) | 0.3 | 0.04 | 0.5 | |
| Nozzle diameter (mm) | 7 | 9 | 5 | |
| Ejection duration (sec) | 20 | 20 | 20 | |
| Fastest decay auto-correlation length (Sal) | 18.72 | 12.14 | 14.82 | 5.02 |
| Feret diameter ratio | 1.05 | 1.19 | 0.82 | 1.45 |

(4) Test Results

The results of evaluations for sliding resistance for each of the pistons are listed in Table 7 below.

TABLE 7

| Zirconia Piston Slidability Evaluation | | | | |
|---|---|---|---|---|
| | Example 6 | Example 7 | Example 8 | Comparative Example 3 |
| Sliding resistance | Extremely low | Medium | Low | High |

It is apparent from the above results that the sliding resistance for each of the pistons of Examples 6 to 8 that had been subjected to the surface treatment method of the present invention was reduced compared to that of the polished product piston of the Comparative Example 3.

In particular, it was confirmed by comparing Examples 6 to 8 that the sliding resistance reduces as the fastest decay autocorrelation length (Sal) increases, and as the ratio between the lengths of the horizontal Feret diameter 1x and the vertical Feret diameter 1y decreases. This confirmed that processing a surface, as in the surface treatment method of the present invention, so as to achieve a large fastest decay autocorrelation length (Sal), and a Feret diameter ratio of close to 1.0, is effective for improving the slidability of ceramic surfaces.

INDUSTRIAL APPLICABILITY

The method of the present invention as described above is applicable to various articles that have ceramic surfaces. The method may be applied to various sliding components such as, for example, ceramic pistons, ceramic rolling elements in bearings, ceramic liner materials, and ceramic coated surfaces of various articles for the purpose of improving slidability and preventing adherence. The method may also be applied to molds and the like that are either made of ceramic or have a ceramic coating for the purpose of improving demoldability.

Moreover, performing surface treatment by the method of the present invention enables a surface to be formed that has good sliding characteristics, that is not susceptible to other members adhering thereto, and that can be easily separated even if adherence occurs. For example, performing the surface treatment of the present invention on kitchenware/kitchen furnishings etc. such as ceramic coated frying pans and ceramic tops of gas ranges etc. enables surfaces to be obtained to which food, burnt food, etc. does not readily adhere, and from which any matter that might have adhered is readily removed. There are accordingly expectations of applications to surface treatments in place of fluororesin treatments and the like.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

The invention claimed is:

1. A method of surface treatment for a ceramic surface, the method comprising:

ejecting substantially spherical ejection particles having a median diameter d50 of from 1 μm to 20 μm, together with compressed gas at an ejection pressure of from 0.01 MPa to 0.7 MPa, onto a surface of a treatment region, this being a portion of a ceramic surface where surface treatment is to be performed, so as to form dimples on the treatment region surface and achieve a value of a fastest decay autocorrelation length (Sal) of the treatment region of not less than 10.

2. The method according to claim 1, wherein the dimples are formed so as to have a plan view profile with a Feret diameter ratio of from 0.7 to 1.43.

3. The method according to claim 2, wherein the dimples have an opening diameter of from 1 μm to 20 μm and a depth of from 0.01 μm to 1 μm.

4. The method according to claim 3, wherein the dimples are formed such that a total surface area of openings of the dimples is not less than 50% of a surface area of the treatment region.

5. The method according to claim 2, wherein the dimples are formed such that a total surface area of openings of the dimples is not less than 50% of a surface area of the treatment region.

6. The method according to claim 1, wherein the dimples have an opening diameter of from 1 μm to 20 μm and a depth of from 0.01 μm to 1 μm.

7. The method according to claim 6, wherein the dimples are formed such that a total surface area of openings of the dimples is not less than 50% of a surface area of the treatment region.

8. The method according to claim 1, wherein the dimples are formed such that a total surface area of openings of the dimples is not less than 50% of a surface area of the treatment region.

9. A ceramic article comprising a treatment region that is at least a portion of a surface section made from ceramic, the treatment region including dimples having an opening diameter of from 1 μm to 20 μm and a depth of from 0.01 μm to 1 μm, and a surface of the treatment region having a value of a fastest decay autocorrelation length (Sal) of not less than 10.

10. The ceramic article according to claim 9 wherein the dimples have a plan view profile with a Feret diameter ratio of from 0.7 to 1.43.

11. The ceramic article according to claim 10, wherein a total surface area of openings of the dimples is not less than 50% of a surface area of the treatment region.

12. The ceramic article according to claim 9, wherein a total surface area of openings of the dimples is not less than 50% of a surface area of the treatment region.

* * * * *